United States Patent [19]

Corteville et al.

[11] Patent Number: 4,967,843

[45] Date of Patent: Nov. 6, 1990

[54] DEVICE FOR PRODUCING AN EFFLUENT CONTAINED IN A SUBMARINE GEOLOGICAL FORMATION AND PRODUCTION METHOD EMPLOYED USING SUCH A DEVICE

[75] Inventors: Jacques Corteville, Rueil-Malmaison; Frederic Hoffmann, Courbevoie, both of France

[73] Assignee: Institut Francais du Petrole, Rueil-Malmaison, France

[21] Appl. No.: 250,839

[22] Filed: Sep. 29, 1988

[30] Foreign Application Priority Data

Sep. 29, 1987 [FR] France ..... 87 13468

[51] Int. Cl.[5] ..... E21B 43/017

[52] U.S. Cl. ..... 166/366; 166/52; 166/54.1; 166/372

[58] Field of Search ..... 166/366, 372, 374, 375, 166/52, 54.1, 335

[56] References Cited

U.S. PATENT DOCUMENTS

| | | | |
|---|---|---|---|
| 2,594,105 | 4/1952 | Watts | 166/75.1 |
| 3,261,398 | 7/1966 | Haeber | 166/366 |
| 3,638,720 | 2/1972 | Thomas | 166/366 |
| 3,777,812 | 12/1973 | Burkhardt et al. | 166/366 |
| 4,152,088 | 5/1979 | Vilan | 405/202 |
| 4,378,848 | 5/1983 | Milberger | 166/366 |
| 4,381,175 | 4/1983 | Erickson | 417/89 |
| 4,442,902 | 4/1984 | Doremus et al. | 166/374 |
| 4,603,735 | 8/1986 | Black | 166/372 |
| 4,705,114 | 11/1987 | Schroeder et al. | 166/366 |
| 4,723,890 | 2/1988 | Corteville et al. | 417/151 |

FOREIGN PATENT DOCUMENTS

| | | | |
|---|---|---|---|
| 3534723 | 6/1987 | Fed. Rep. of Germany . | |
| 87/01159 | 2/1987 | PCT Int'l Appl. | 166/335 |

OTHER PUBLICATIONS

World Oil, "Jet Pumping Oil Wells", vol. 197, No. 6, Nov., 1983, pp. 51–56.

*Primary Examiner*—Ramon S. Britts
*Assistant Examiner*—Terry Lee Melius
*Attorney, Agent, or Firm*—Antonelli, Terry, Stout & Kraus

[57] ABSTRACT

A method and device for producing effluent contained in a submarine geological formation which enables a submarine transfer of a petroleum output over short and medium distances between, for example, a hydrocarbon deposit and a hydrocarbon processing platform located over a larger deposit developed previously. At least one wellhead of the wells in the geological formation is connected to a production line feeding into the processing platform, with a pumping module being provided in the form of a jet pump connecting the wellheads to the production line whereby the hydrocarbons are pumped from the outlets of the well heads to the processing zone by the jet pump.

8 Claims, 2 Drawing Sheets

DEVICE FOR PRODUCING AN EFFLUENT CONTAINED IN A SUBMARINE GEOLOGICAL FORMATION AND PRODUCTION METHOD EMPLOYED USING SUCH A DEVICE

BACKGROUND OF THE INVENTION

The present invention relates to a device for producing effluent contained in a submarine geological formation and a production method implemented by means of such a device. It applies in particular to submarine transfer of petroleum output over short and medium distances, for example between a hydrocarbon deposit and a hydrocarbon processing platform located over a larger deposit developed previously.

The devices for producing the effluent contained in a submarine geological formation that are usually employed in oilfields, include at least one drilled well, each of said wells extending from a low end in a hydrocarbon reservoir to a high end forming a wellhead located essentially above the seabed, at least one of said wellheads being connected to a production line feeding into a processing zone such as, in particular, a platform. A rig of this type is described in particular in U.S. Pat. No. 4,152,088.

In such types of offshore production, the use of electric pumps, or a gas injection process commonly known as "gas-lift", is known to improve extraction of effluents from the formation and to facilitate transfer to a remote platform. These assisted production processes are expensive in both outlay and operation.

Hence, the goal of the present invention is to overcome the above drawbacks by providing a less expensive effluent production device which benefits from ease of use, particularly in terms of damaged parts replacement.

The source idea of the present invention is to propose a device and a method using a jet pump, also called ejector pump, located essentially on the seabed, at the outlet of the wellhead or after a group of valves (manifold) which allows the output from several wells to be grouped to improve extraction of effluents from a submarine geological formation and permit transfer to remote processing facilities.

A jet pump which can in particular be used as part of the present invention is of the type described in French application No. 87/08.919 filed by the present applicant. This pump allows fluids to be raised in a well through the inside of the tubing and, in addition to the lower installation, maintenance, and operating cost, and its ruggedness ensures great operating reliability superior in particular to that of electric pumps. In addition, such pumps allow improved conservation of pumping energy output under multiphase intake conditions when the relative quantities of gas and liquid to be recompressed vary. Finally, these pumps allow good regulation flexibility as a function of the intake conditions, particularly by adjusting the flowrate of the drive fluid, a short reaction time when the settings are changed, and good ability to pump viscous, corrosive, or caking fluids.

Thus, the goal of the present invention is an effluent production device contained in a submarine geological formation having at least one drilled well, each of said wells extending from a low end in a hydrocarbon reservoir to a high end forming a wellhead located essentially above the seabed, at least one of said wellheads being connected to a production line feeding into a processing zone such as, in particular, a platform, characterized by also having a pumping module located on the seabed provided with a jet pump connecting the wellheads to the production line, with the hydrocarbon being pumped from the wellhead outlets to the storage zone by said jet pump.

The present invention is particularly useful when used with the pumped tools and instruments technique usually known by the initials TFL (from the English "Through Flow Line.") This technique makes it possible to install or remove one or more jet pumps as desired to adjust their setting parameters or carry out inspection and maintenance operations.

In one particular embodiment, the effluent production device is characterized by at least one of the wells having a jet pump located at a given depth inside the well in order to pump the effluent from the formation to the wellhead.

Such a device enables a geological formation to be worked in a flexible manner appropriate to each of the wells, particularly when the formation is heterogeneous and has already been worked and decompressed.

After bringing the output from several wellheads into a manifold, a first jet pump may be disposed downstream of this manifold to recompress the entire output. Simultaneously or sequentially, depending on how output of the various wells is developing, one or more jet pumps (one per well) may be placed at the appropriate depth, which is a function of the degree of completion of the wells and the hydrostatic pressure of the effluent, with or at the bottoms of the wells, the hydraulic characteristics of said pumps being matched to the pressures and flowrates of the fluids to be pumped. These jet pumps may be installed and removed by the TFL technique.

A switching device, each of whose branches is connected to one wellhead and whose reunifying element is connected to the jet pump, is placed advantageously upstream of the pumping module disposed on the seabed.

In one particular embodiment, a drive fluid line coming from the processing zone feeds into the pumping module as well as each of the wellheads.

According to a first embodiment, the drilled wells each have coaxial tubing outside a production tube in which a jet pump is disposed, the production tube being connected at the level of the wellhead with a branch of the switching device and the annular volume located between the tubing and the production tube being connected to the drive fluid line.

According to a second embodiment, the drilled wells each have tubing in which is disposed a first tube receiving the jet pump for effluent production and connected at the wellhead to one branch of the switching device, and a second tube connected at the wellhead with the drive fluid line for feeding the jet pump.

The present invention also includes a method for producing effluent contained in a submarine geological formation, implemented in the device as described above, wherein a drive fluid is injected into the fluid line and flows from the platform to the jet pump of a pumping module, with the pumped effluent being collected through the production line and being brought up to the pumping module in the production tube.

Advantageously, the jet pump of the pumping module and the jet pumps located one in each well are controlled simultaneously by the drive fluid line.

In a preferred embodiment, in which the jet pumps are of the pumped tool and instrument type, these pumps are lowered and raised from the platform in the production line toward the pumping module, then toward each of the wells by the switching device.

Advantageously, a tool diameter changing device is used when the pumped tools are lowered inside the pumping module.

BRIEF DESCRIPTION OF THE DRAWINGS

A particular non-limitative embodiment of the invention which will explain the essential characteristics and advantages will now be described in greater detail in connection with the accompanying drawings wherein.

DETAILED DESCRIPTION

Figure 1:
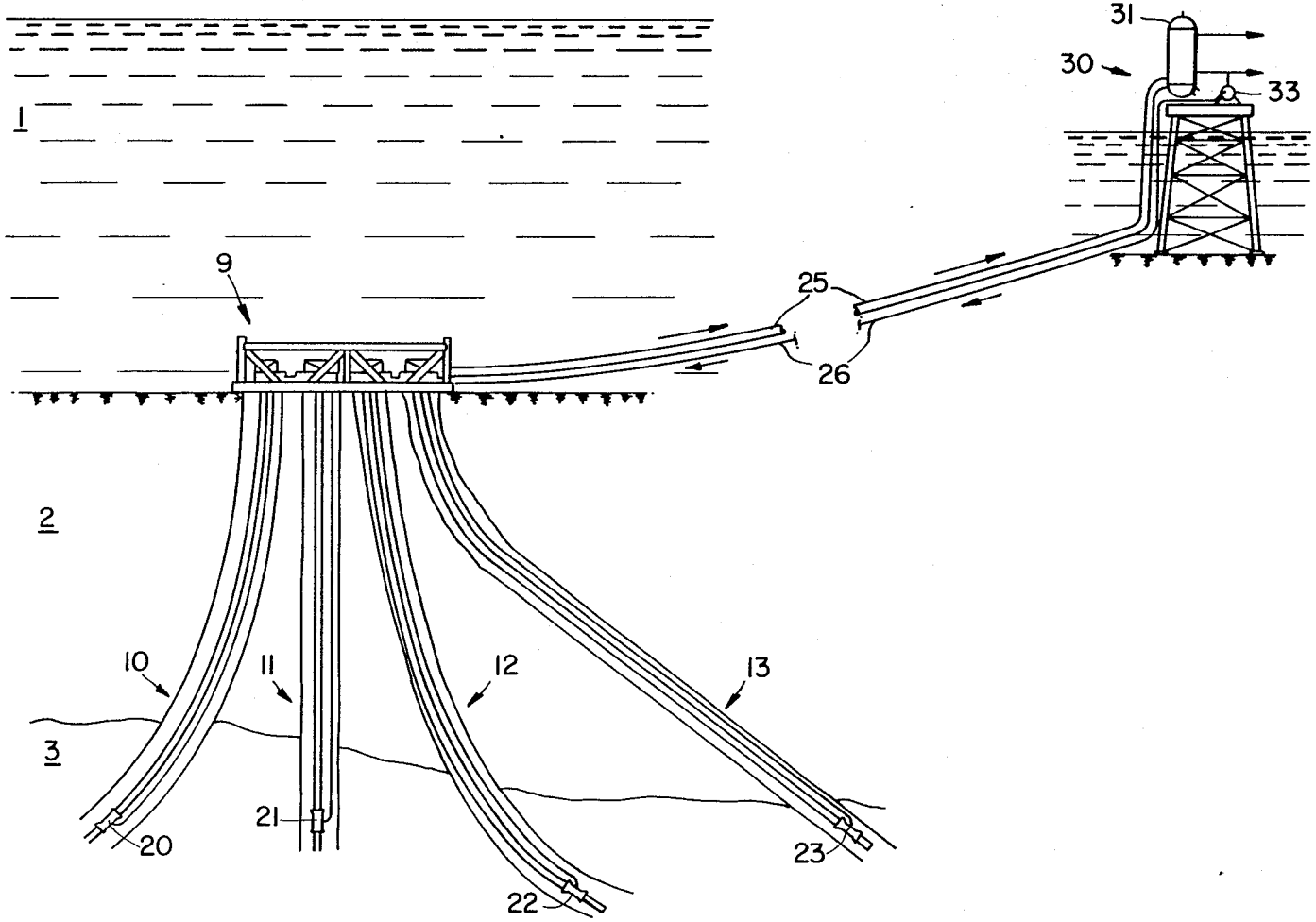
FIG. 1 is a schematic view of the effluent production device according to the present invention.

The example chosen and illustrated in FIG. 1 describes one of the methods of activating submarine production of crude. FIG. 1 shows offshore element 1 as a whole, seabed 2, and geological formation 3 impregnated with the fluids to be extracted such as crude oil mixed with natural gas which may be associated with oilfield water. Production takes place by various wells generally designated by the reference numerals 10, 11, 12, 13 distributed such as to drain the entire deposit efficiently. The number of wells shown in the chosen example is limited to four, so that the various possible types of equipment used in effluent production can be shown.

The wells shown 10, 11, 12, and 13, are cluster wells located in a zone with insufficient bottom pressure, and all four wells 10-13 require activation inside the well. These wells are then connected by a production line 25 to a remote processing platform facility generally designated by the reference numeral 30.

Each of the wells 10, 13 extends from a low end in a hydrocarbon reservoir to a high end, and a wellhead generally designated by the reference numeral 9 is located essentially above seabed 2.

The wells 10–13 are each equipped with nonclassical jet pumps 20, 21, 22, 23 respectively located at appropriate depths suitable for the conditions of each well, able to be installed and removed by the pumped tools technique, ensuring production through the inside of the central tubing, with the annular space being used for injection of drive fluid, for example according to the process described in French Pat. No. 2,581,427. corresponding to U.S. Pat. No. 4,723,890.

Figure 2:
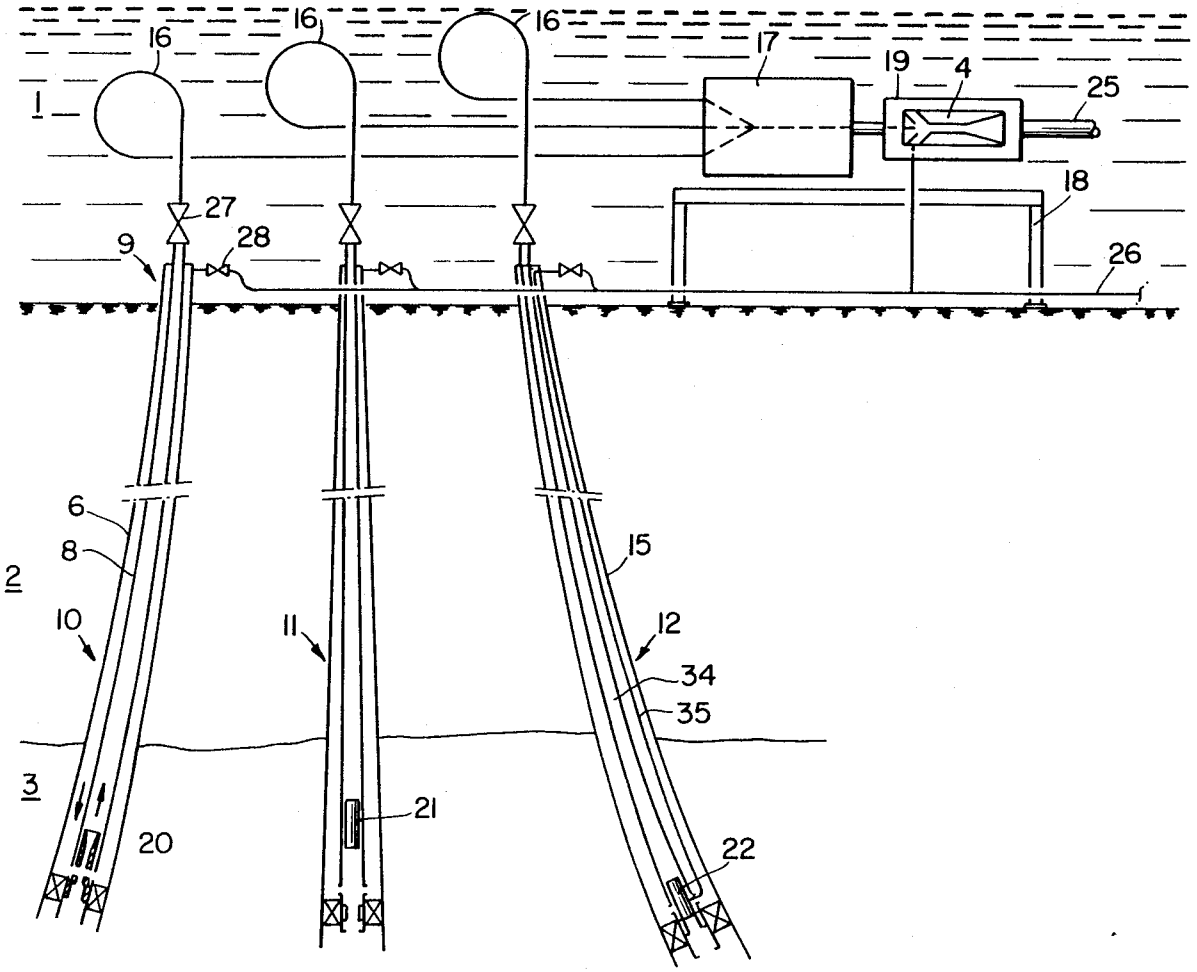
FIG. 2 is a schematic view of the production device at the seabed, including the various drilled wells.

Wells 10 and 11 (FIG. 2) represent such a design in which a tube 6 contains a production tube 6, 8 the annular volume between the two tubes 34, 35 being used for injection of drive fluid.

However, as shown in the case of well 12, the invention may have the same advantages when two tubes 34, 35 are used inside a tubing 15, with the first tube 34 serving as production tubing and a second tube 35 for injecting drive fluid into the jet pump.

Wellheads 9, identical on each well, are of the TFL type having a single expansion loop 16 for installing and removing pumped tools, in particular allowing passage of TFL jet pumps whose articulated equipment has well-defined dimensions. Expansion loops 16 are connected to a submarine module 17 for switching the pumped tools, also ensuring the grouping of output from each of the wells 10, 13.

This switching module may be the "Rotatif Diverter Module" developed by the Societe Francaise Ateliers et Chantier de Bretagne. It allows the movement of the tools to be directed to or from each of the TFL wells, as desired. This module is installed on a suitable submarine baseplate 18, comparable to the UMC (underwater manifold center) of the Shell and Esso companies used at the North Sea Cormorant oilfield. This baseplate 18 allows the main elements for monitoring, controlling, and transferring submarine output to be grouped and connected. On this baseplate, in connection with the submarine switching module 17 located upstream, is disposed a pumping module 19 for pumping the fluids produced by the various wells. This pumping module 19 has essentially a jet pump 4 with dimensions and geometric shapes similar to those of the well-bottom jet pumps, but with larger dimensions to allow the output of each of the wells to be recompressed, the effluents from the deposit and drive fluids having allowed the wells equipped with jet pumps to be activated.

This jet pump is equipped with connection and disconnection devices inside the pumping module 19 that are comparable to those used in TFL technology, possibly with the aid of attached pumpable tools, allowing the jet pump 4 to be brought through the production line 25 to the processing platform 30, then to be replaced at the seabed by reverse circulation. These movements may be controlled by associated hydraulic or electrohydraulic control systems, through umbilical links.

Thus, this arrangement allows for easy adjustment and maintenance of this jet pump 4 during brief halts in production which depend largely on the distance between the submarine station and the platform. To allow the well-bottom TFL pumps also to be brought up or re-installed by the same method through production line 25, the pumping module 19 is equipped with a device for storing and connecting sealing elements to the pumped tools, to allow the TFL jet pumps to move in the "*collecteur production line*"25 with a larger diameter than that of the oil tubings, according to a process developed by the Otis company which has become classical in TFL technology.

To bring TFL well pumps back to the platform it is necessary, through the appropriate controls, to lift submarine jet pump 4 of the pumping module according to the method indicated above, then to trigger the return of well-bottom jet pumps 20, 21, 22, 23 either by reversing the direction of drive fluid circulation (which is a classical operation when the flow is through the annular space) or, preferably, with the aid of appropriate TFL tools. The well-bottom TFL pumps 20–23 then move through the wellheads 9, the submarine switching module 17, the submarine pumping module 19, and the production line 25. They are replaced at the bottom of the well by a procedure according to the same principles.

Production line 25 and the drive fluid line 26 to the other links may be buried in a trench between the foot and platform to avoid accidents caused, for example, by snagging fishing nets or any other object moving near the seabed 2.

Platform facility 30 (FIG. 1) has a separator 31 fed by an output line which separates the gaseous part from the liquid part of the effluent. A fraction of the liquid part of the effluent (water or crude) is repressurized in pump 33 to produce the drive fluid required to operate well-bottom jet pumps 10, 11, 12, 13 and the submarine jet pump 4 of the pumping module 19. The nonrecycled liquid hydrocarbons as well as the gas are generally transferred in separate lines either to storage means or to other facilities such as processing facilities or another platform.

The drive fluid is, for example, pressurized from 200 to 300 bars (20 to 30 MPa) when an effluent overpressure of 30 bars (3 MPA) is to be produced in the first jet pump. This overpressure corresponds approximately to that necessary for transferring the output over a distance of about 30 km. This drive fluid, through a high-pressure pipe 26 with a diameter which may be less than that of the production line (for example 6⅝" for the high-pressure pipe and 8⅝" for the production line) supplies the various well-bottom or submarine jet pumps of the pumping module. Valves 27 judiciously placed at the wellhead 9 and on baseplate 18 ensure operating safety and allow wells that are to be taken out of production, to be taken out of the circuit. The drive fluid can thus have two functions: during installation or removal of the jet pumps or other tools: movement of these devices; in normal operation: supply of the drive fluid according to distribution controlled by the size of the nozzles with which the various well-bottom or submarine pumps are fitted.

Thus, each of pumps 20, 21, 22, 23 can operate at drive fluid flowrate and pressure characteristics that match production specifications.

All the pipes, expansion loops 16, and hydraulic links in the well, at the wellhead 9, or in the vicinity of the wellheads as well as the various lines are equipped with valves and branch lines, not shown in the figures for greater clarity, the placement of which will be fully known to the individual skilled in the art. The operating system presented in this example offers the advantage of allowing activation of production both at the well bottom and at the seabed with a minimum of connecting pipes between the deposit and the platform. However, the process can also function with independent activation systems for the well bottom and the submarine station, with the drive fluid being supplied through multiple pumping lines, one for the offshore station and one for all the wells or one for each well. Finally, the wells may be completed by other alternative methods. In particular, the more classical double TFL completions, with two tubes in each well, may be adopted without changing the operating options indicated.

We claim:

1. Device for producing effluent contained in a submarine geological formation having at least one drilled well, said at least one drilled well extending from a low end in a hydrocarbon reservoir to a high end forming at least one wellhead located essentially above the seabed, a jet pump means located at a given depth inside said well for pumping the effluent out of the formation up to the at least one wellhead, a production line means connected to said at least one well head for feeding into a processing zone, and a pumping means provided with a jet pump means connecting the at least one wellhead to the production line means for pumping hydrocarbons from outlets of the at least one well head to the processing zone.

2. Device for producing effluent according to claim 1, further comprising a switching means placed upstream of said pumping means, said switching means including a plurality of branches respectively connected to the at least one wellhead, and reunifying means for connecting the branches to the jet pump means of the pumping means.

3. Device for producing effluent according to one of claims 1 or 2, wherein a drive fluid line means coming from the processing zone is forwarded between the pumping means and said at least one wellhead.

4. Device for producing effluent according to claim 2, wherein said at least one drilled well includes coaxial tubing means disposed outside a production tube means through which the jet pump, means to be located at the given depth of the well is lowered, said production tube means being connected at the level of the at least one wellhead with one of said branches of said switching means, and wherein an annular volume located between the coaxial tubing means and the production tube means is connected to a drive fluid line means.

5. Device for producing effluent according to calim 2, wherein said at least one drilled well includes a tubing means in which a first tube means is disposed, said first tube means receive the jet pump meand to be located at the given depth of the well and is connected at the at least one wellhead with one of said branches of said switching means, and a second tube means is connected at the at least one wellhead with a drive fluid line means for feeding the jet pump means of pumping means.

6. A method for producing effluent contained in a submarine geological formation having at least one drilled well, said at least one drilled well extending from a low end in a hydrocarbon reservoir to a high end forming at least one wellhead located essentially above the seabed, the method comprising the steps of:

providing a production line means feeding into a processing zone located at a distance from said at least one wellhead;

connecting the production line means with said at least one wellhead;

providing a pumping module including a jet pump means for pumping effluent from the outlets of the at least one well head to the processing zone;

injecting a drive fluid into a drive fluid line means from the processing zone toward a jet pump means located at a given depth in the at least one well for pumping effluent out of the geological formation up to the at least one wellhead;

simultaneously controlling the jet pump means of the pumping module and the jet pump means located at the certain depth in said at least one well by said drive fluid ; and collecting through the production line means the effluent pumped in the formation by the jet pump means located at a given depth in the at least one well and supplied to the processing zone through the production line means by the jet pump means of the pumping module.

7. Method for producing effluent according to claim 6, wherein the jet pump means located at the certain depth of the at least one well are of the pumped tool and instrument type, and wherein the method further comprises the step of:

providing a switching means for enabling the jet pump means located at the certain depth to be lowered and raised from the processing zone in the production line means in a direction of the pumping module and in a direction of said at least one well.

8. Method for producing effluent according to claim 7, further comprising the step of changing a diameter of the pumped tool and instrument by a tool-diameter-changing means when lowering the same inside the pumping module.

* * * * *